US006702203B2

(12) United States Patent
Jou

(10) Patent No.: US 6,702,203 B2
(45) Date of Patent: Mar. 9, 2004

(54) DUAL SPRAY GUN FOR PAINTING AND CLEANING

(76) Inventor: Wuu-Cheau Jou, No. 497-6, Tsao Hu Road, Da Li City, Taichung Hsien (TW)

( * ) Notice: Subject to any disclaimer, the term of this patent is extended or adjusted under 35 U.S.C. 154(b) by 0 days.

(21) Appl. No.: 10/061,207

(22) Filed: Feb. 4, 2002

(65) Prior Publication Data

US 2003/0146298 A1 Aug. 7, 2003

(51) Int. Cl.[7] ..... B05B 7/30; B05B 9/03; A62C 13/62; A62C 13/66; A62C 35/58

(52) U.S. Cl. ..... 239/346; 239/302; 239/340; 239/369; 239/419; 239/433; 239/526

(58) Field of Search ..... 239/346, 340, 239/369, 419, 433, 526, 302, 344, 371, 423, 575, 600, DIG. 14, DIG. 23

(56) References Cited

U.S. PATENT DOCUMENTS 1,787,583 A * 1/1931 Larson ..... 239/416.2
1,843,269 A * 2/1932 Casper ..... 220/325
2,263,843 A * 11/1941 Gross ..... 220/248
3,032,277 A * 5/1962 Petty ..... 239/408
3,240,398 A * 3/1966 Dalton, Jr. ..... 222/630
3,401,842 A * 9/1968 Morrison ..... 222/183
3,432,104 A * 3/1969 Kaltenbach ..... 239/328
3,714,967 A * 2/1973 Zupan et al. ..... 137/588
5,765,758 A * 6/1998 Chu ..... 239/369
6,142,387 A * 11/2000 Jou ..... 239/390
6,383,062 B1 * 5/2002 Jou ..... 451/90

* cited by examiner

*Primary Examiner*—Michael Mar
*Assistant Examiner*—Darren Gorman
(74) *Attorney, Agent, or Firm*—Charles E. Baxley

(57) ABSTRACT

The present invention relates to a dual spray gun for painting and cleaning, and more particularly, to a combined tin and pipe dual spray gun for painting and cleaning, which can be used separately and independently, increasing working radius at will, and can be used in unitized construction, depending on the working environments. The present invention includes a T-shaped main body, which is connected with an air blow-gun at a back end, and connected to a blow head at a front end. A pipe is secured on a vertical sucking tap hole. A tank is connected on a tip end of the pipe to construct a combined tin and pipe structure. The tank can be connected on the T-shaped main body directly to construct a tin structure or the pipe can be connected on the T-shaped main body to construct a pipe structure. So the three structures can meet necessities of any working environment so that the working radius is extended infinitely.

3 Claims, 6 Drawing Sheets

DUAL SPRAY GUN FOR PAINTING AND CLEANING

BACKGROUND OF THE INVENTION

1. Field of the Invention

The present invention relates to a dual spray gun for painting and cleaning, and more particularly, to a dual spray gun that combines tin and pipe sucking methods into one set that can be used separately and independently or in a series connection so as to improve the painting or cleaning operation.

2. Description of the Prior Art

In accordance with a conventional dual spray gun for painting and cleaning used for painting priming paint or cleaning various work-pieces, whether sucking up paint or cleaner, most of the dual spray guns can be divided into a tin dual spray gun 11, as shown in FIG. 1, and a pipe dual spray gun 12, as shown in FIG. 2, for suiting different working environments.

For example, the tin dual spray gun 11 carries less paint or cleaner and is used in smaller working area painting or cleaning for a shorter working period, but it has shortcomings just like heavier units that limit wrist and hand dexterity making the wrist tire easily and working period shorter.

The pipe dual spray gun 12 with a long pipe 121 can use a large tank 13 at the other end of the pipe 121, supplying more paint or cleaner to be sucked up and sprayed out for meeting the necessity of larger working areas. Meanwhile, the working radius is increased due to the pipe 121. The pipe dual spray gun 12, by the larger tank 13 providing more paint or cleaner, overcomes the shortcoming of interruption of the liquid in the tin, instead supplying enough liquid so that a larger working area can be processed and a larger working radius is achieved by means of the longer pipe 121.

Although it has so many merits, there are some demerits obviously existing. For example, because the worker has to move often for adjusting position during working, sometimes he or she forgets the length limit of the pipe 121 when moving and overruns the length of the pipe 121 so that the pipe 121 is withdrawn out from the surface of the liquid in the tank and interrupts the spraying process unexpectedly affecting the quality of painting and delay work. On the other hand, the tank 13 is easily overturned by dragging the pipe 121 or by being run into by a passing worker casually to cause the paint or cleaner liquid to run out, so the operator has to pay attention to the positions of the tank 13 and the pipe 121 all the time, distracting his attention and further affecting job quality.

The above-mentioned tin and pipe spray guns are designed professionally to work independently. If the user has to use both methods on a job, he or she would buy the two kinds of dual spray guns for painting and cleaning because they can not be used convertibly or alternatively. Therefore, the cost must be higher and the operation is inconvenienced.

OBJECTS AND SUMMARY OF THE INVENTION

It is therefore a main object of the present invention to provide a combined tin and pipe dual spray gun for painting and cleaning, which can be used convertibly and alternatively in tin style and pipe style with low cost and improved operation.

DETAILED DESCRIPTION OF PREFERRED EMBODIMENTS

Figure 1:
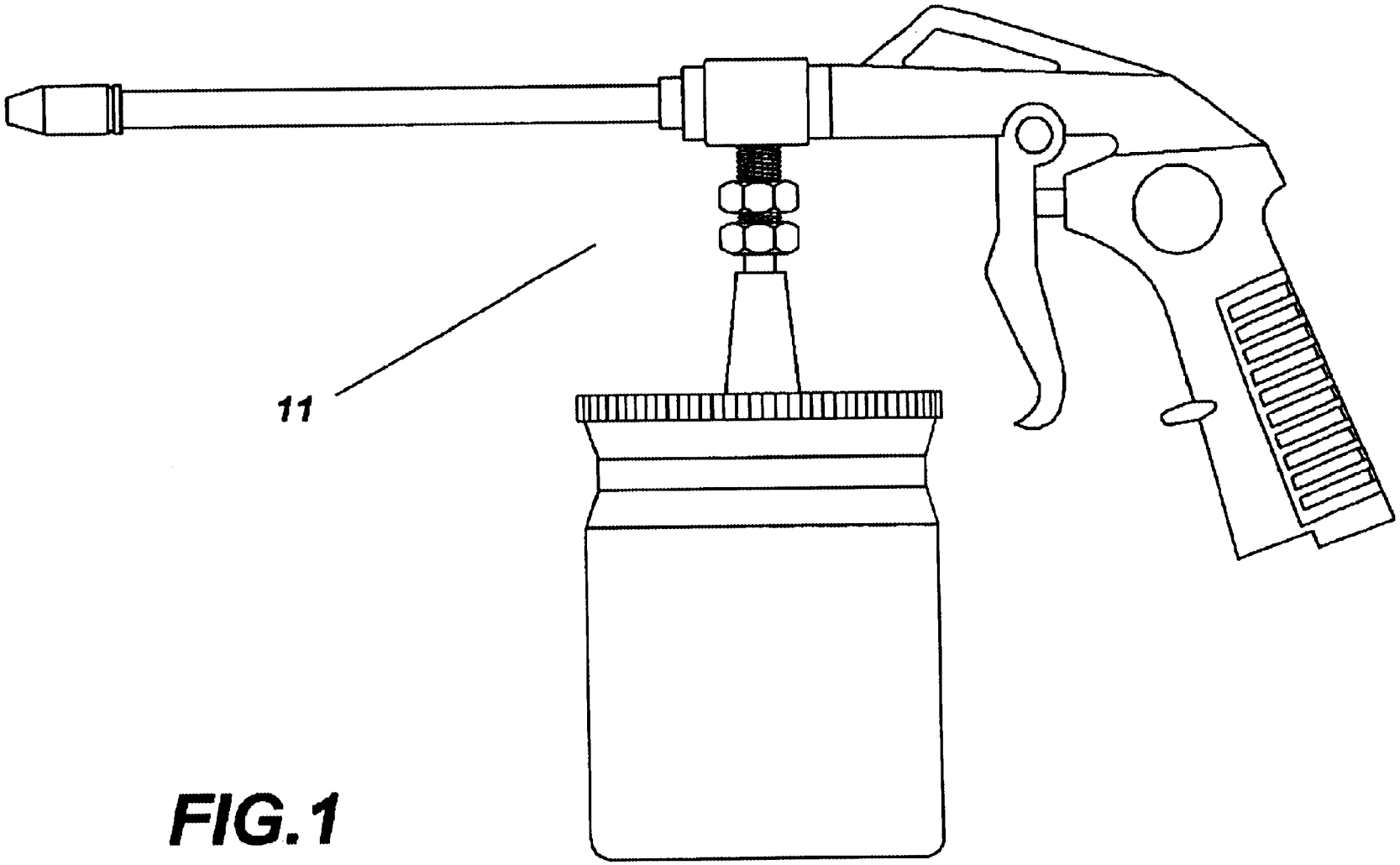
FIG.1 Prior Art
FIG. 1 is a side view of a conventional tin dual spray gun.
Figure 2:
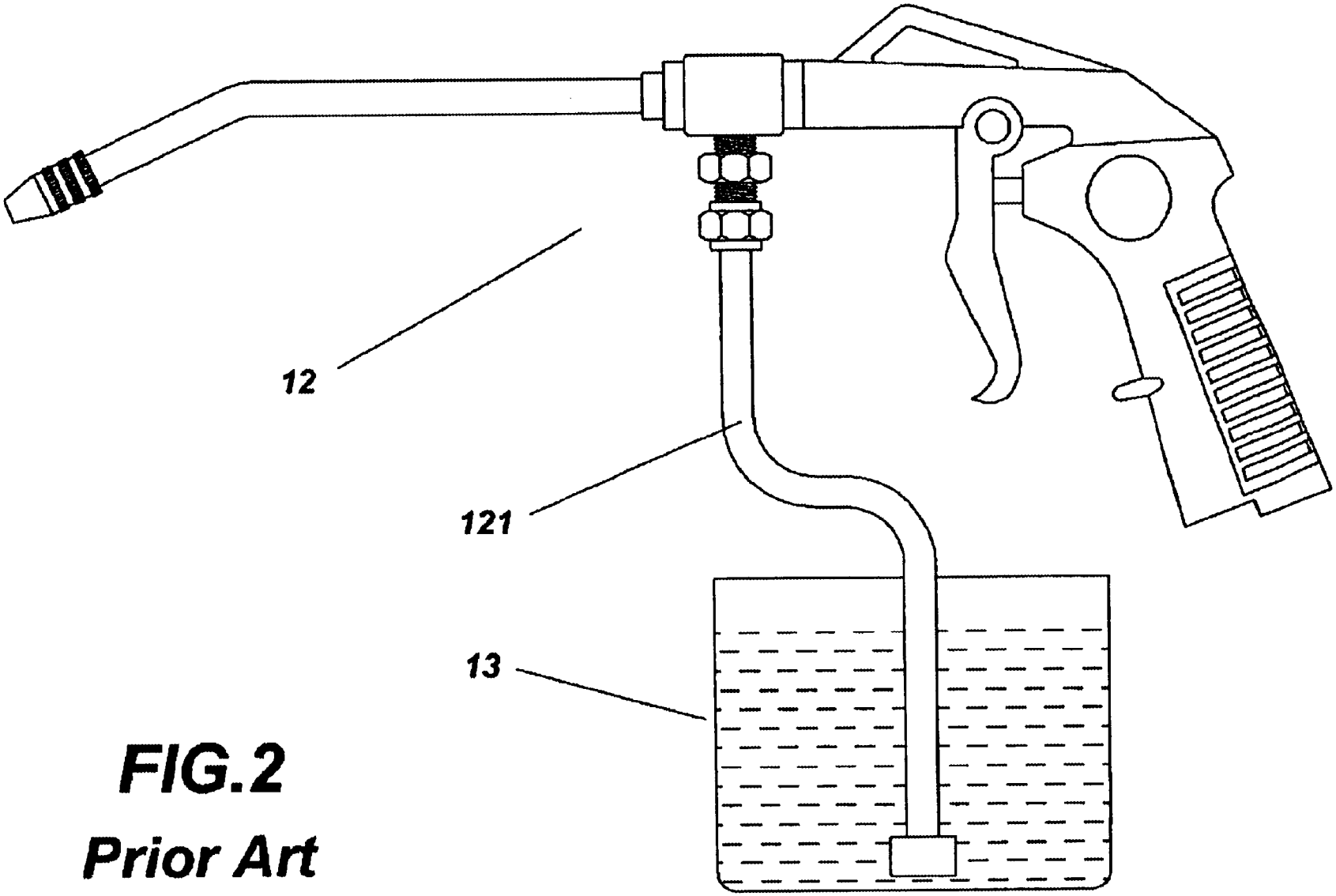
FIG.2 Prior Art
FIG. 2 is a side view of a conventional pipe dual spray gun.
Figure 3:
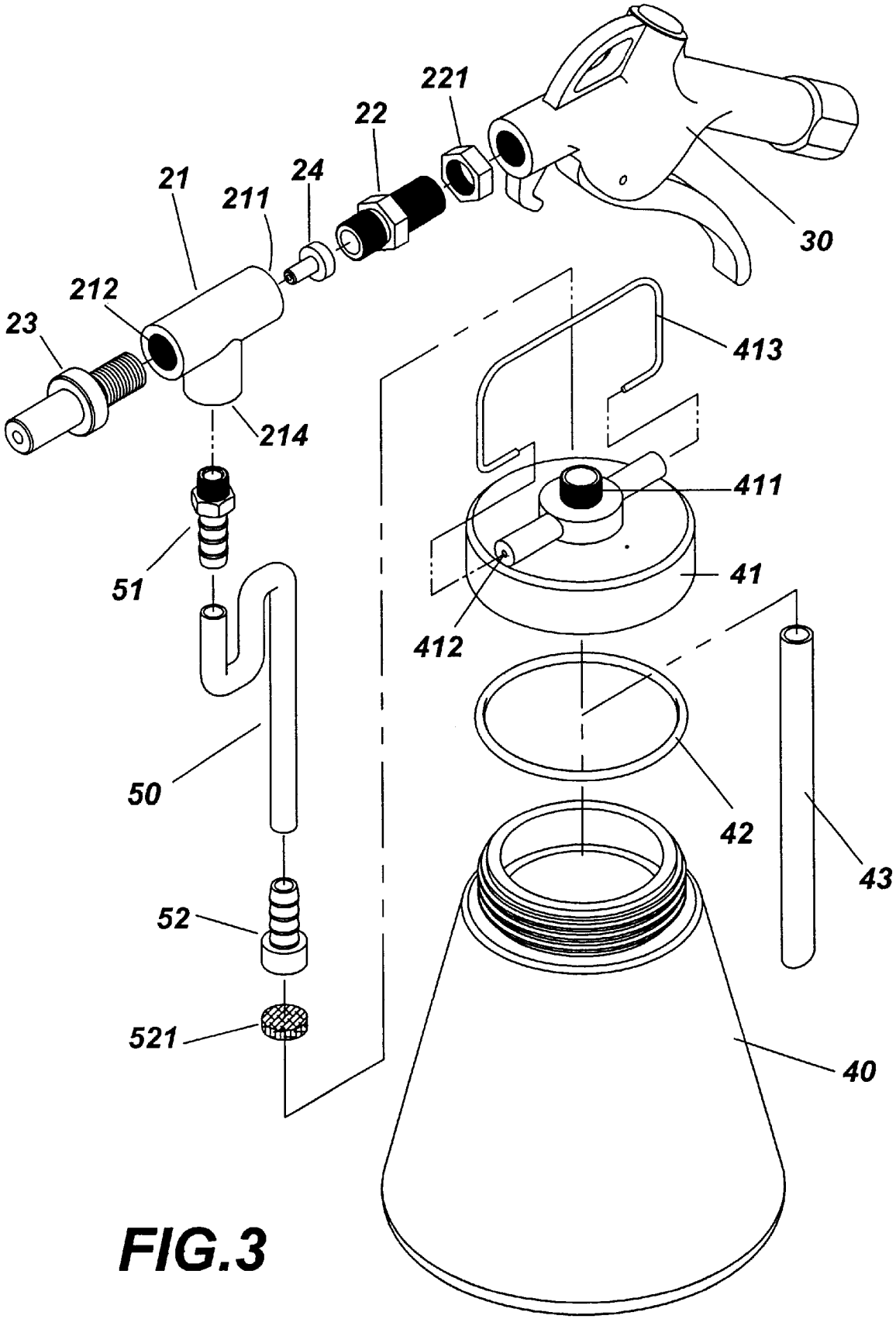
FIG. 3 is an exploded view of the present invention.
Figure 4:
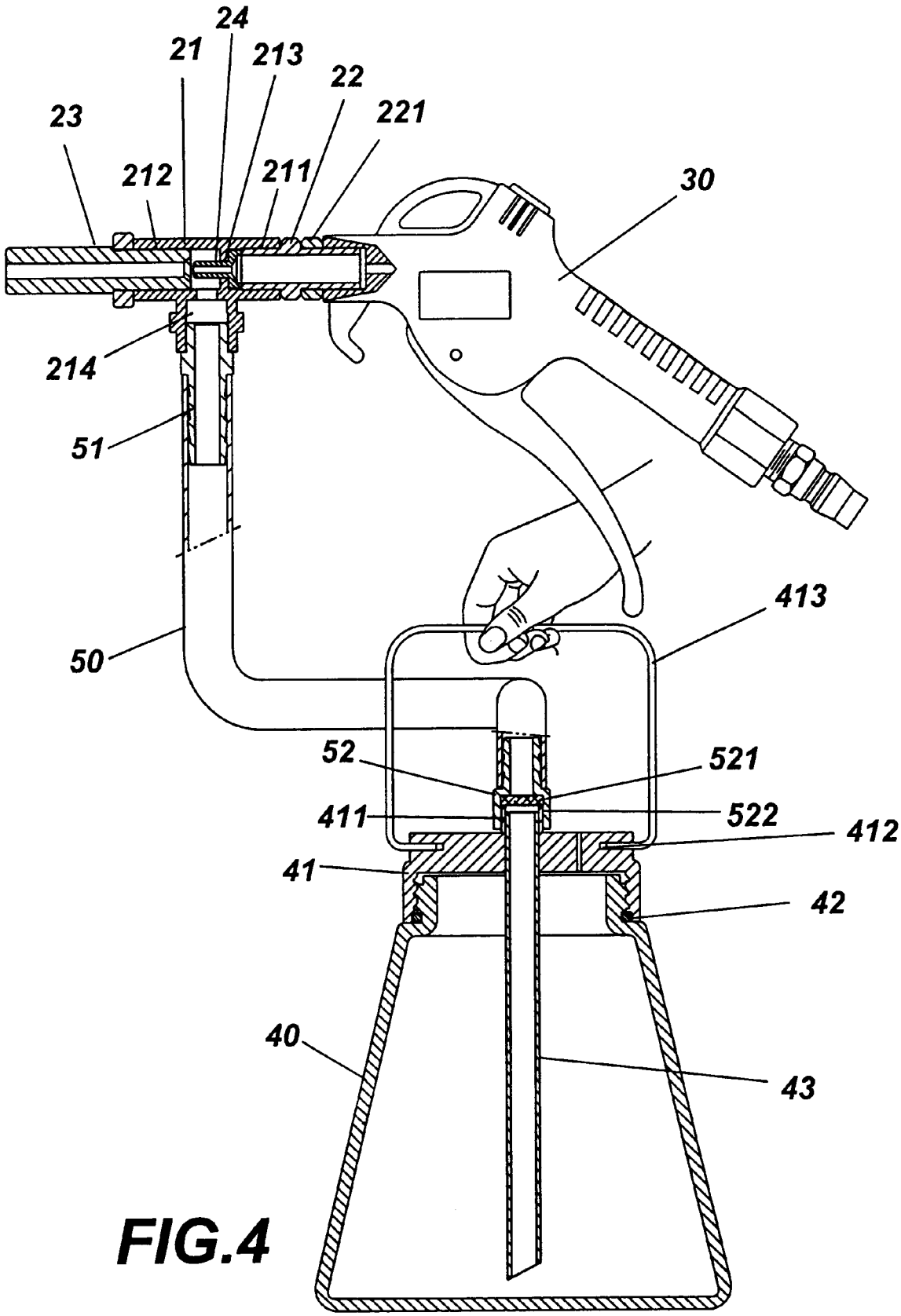
FIG. 4 is a cross-sectional view of the present invention.

Referring to FIG. 3 and FIG. 4, the present invention is comprised of a three-way T-shaped main body 21 having an inlet tap hole 211 for securing to an air blowgun 30 via a combined bolt 22 and a locating nut 221, a front tap hole 212 for securing a blow head 23, a downward sucking tap hole 214 connecting to the front tap hole 212, and a through-hole 213 connecting the front tap hole 212 and the sucking tap hole 214 to the inlet tap hole 211 for locating an atomized nozzle 24 from the inlet tap hole 211 side so that a tip end of the nozzle 24 stretches inside the front tap hole 212 and above the sucking tap hole 214. The sucking tap hole 214 is used for securing on a pipe connection 51 at one end of a pipe 50.

A filter connection 52, holding a filter leaf 521 for filtering foreign matter, is on the other end of the pipe 50. An internal screw 522 is built on the inside of the filter connection 52 for securing on a bolt 411 with a through-hole on a cap 41 of a tank 40 that is sealed with an O-ring 42. The bolt 411 with the through-hole built on a top side of the cap 41 also can be secured on the sucking tap hole 214 of the T-shaped main body 21. The cap 41 has a sucking tube 43 extending at a bottom side connecting to the through-hole of the bolt 411 for sucking up the paint or cleaner contained in the tank 40. The cap 41 also has a pair of pivoting holes 412 for a C-shaped handle 413 for carrying.

The above-mentioned mechanism of the combined tin and pipe dual spray gun provided by the present invention can be used as an individual tin spray gun or as an independent pipe spray gun, or as a combined tin and pipe dual spray gun, as follows:

4. Used in a combined tin and pipe method:

Referring to FIG. 3 and FIG. 4, the T-shaped main body 21 connects to the pipe connection 51 of the pipe 50 the same way as above-described. The other end of the pipe 50, via the filter connection 52, connects to the cap 41 of the tank 40 to construct a combined longer pipe and tank dual spray gun. Because the tank 40 not only can be put in a proper position, but also carried with the user moving to the working site, the working radius can be increased at will. Meanwhile, it not only overcomes the demerit of the conventional tin dual spray gun, like being heavy, but also has the merit of the conventional pipe dual spray gun, as being light and being a longer working radius.

Due to adopting screwing connections between the tank 40 and the pipe 50, even if the tank 40 is overturned by dragging the pipe 50, the sealed tank 40 still can keep the liquid inside without running out, and with moving of the tank 40, the working radius can be increased infinitely. The tank 40 not only can be put on the ground, but also hung at different heights above the ground according to the necessity of the working environment. Besides, the operator can carry the tank 40 with one hand, while the other hand can hold the spray gun 30 so that processing becomes more rapid and more facilitated.

Figure 5:
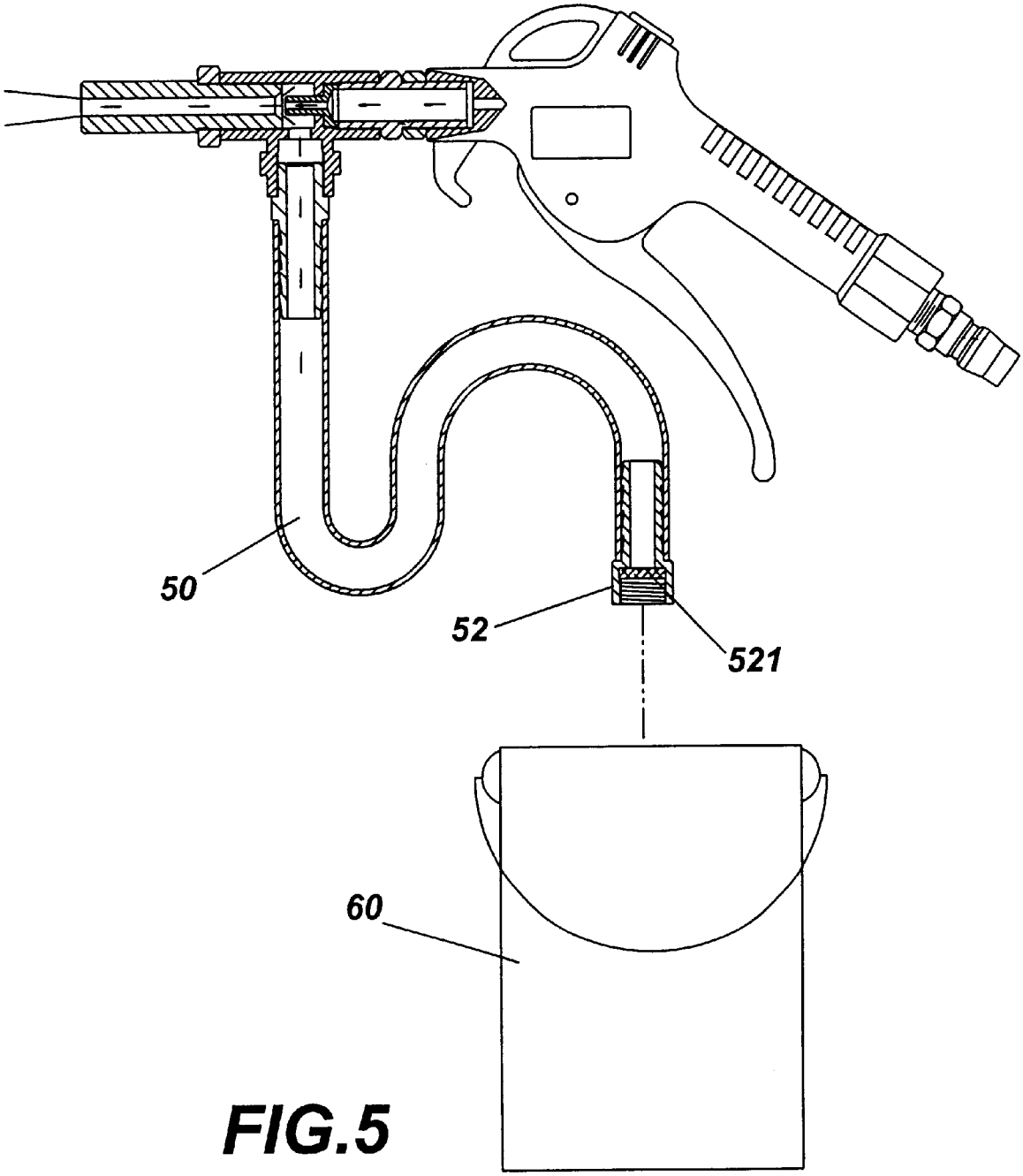
FIG. 5 is a cross-sectional view showing the pipe method of the present invention.

5. Used in a pipe method:

Referring to FIG. 5, the filter connection 52 on the tip end of the pipe 50 can be used independently, thereby not only filtering foreign matter with the filter leaf 521 held inside of the filter connection 52, but also being in the painting tank 60 directly, whether small or big, working as the conventional pipe spray gun. In painting, the filter connection 52 can be put into a variety of painting tanks, and in cleaning, the cleaner tank can be used directly by putting it on the filter connection 52 end of the pipe 50.

Figure 6:
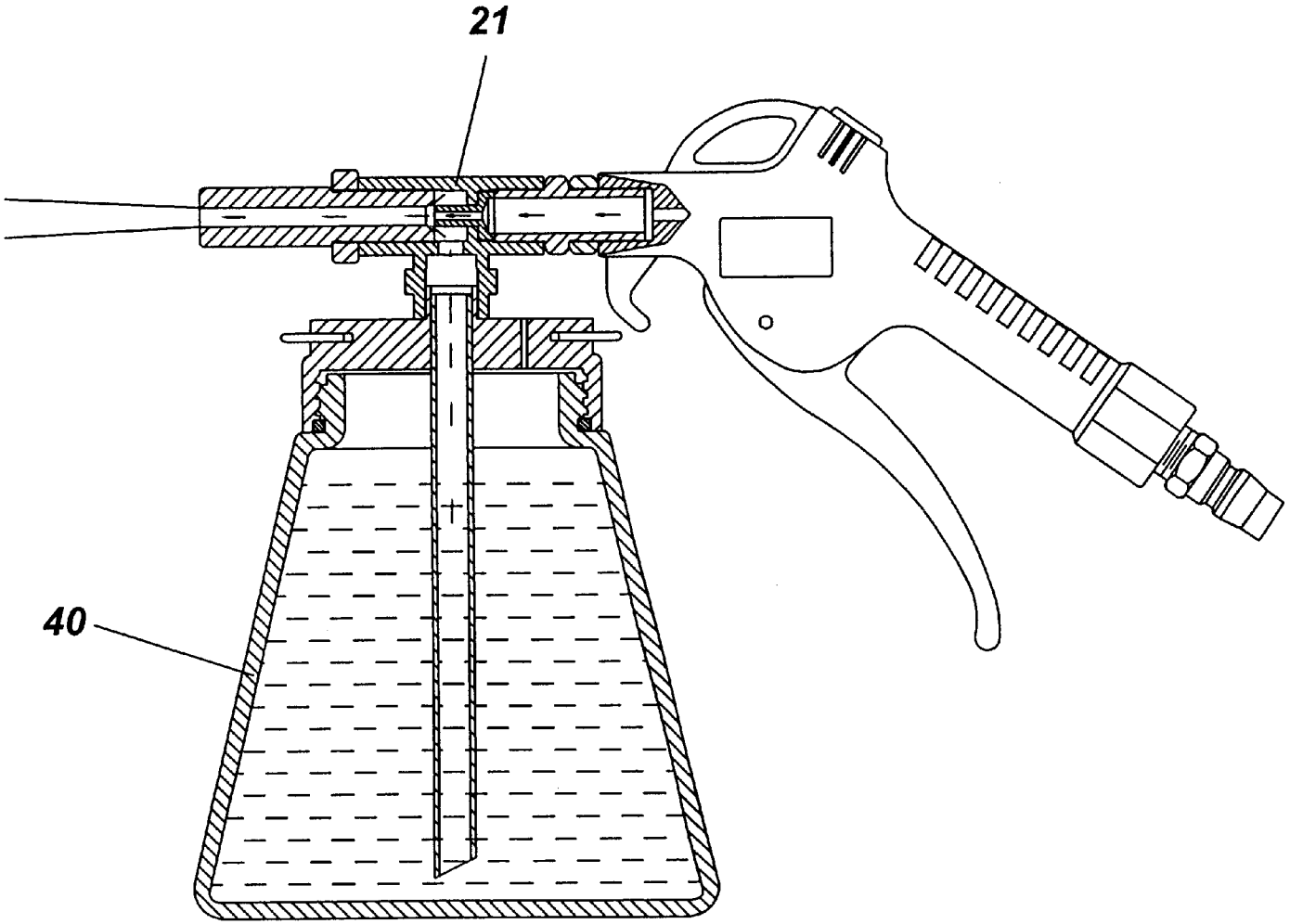
FIG. 6 is a cross-sectional view showing the tin method of the present invention.

6. Used in a tin method:

Referring to FIG. 6, the tank 40 can be secured on the T-shaped main body 21 to construct a tin dual spray gun for painting and cleaning, like the conventional one, it can be selected depending on necessity of the working environment.

Therefore, according to the above-described, we find that the present invention has the following merits:

1. Used in the combined tin and pipe method makes the working radius extend infinitely in a painting or cleaning process. Meanwhile the tank not only can be set at different heights, but also can be carried and according to the necessity of the working environment, it can be moved or placed at will, so it has higher mobility and facility, without any worry of spilling caused by overturning.
2. Combining the tank and the T-shaped main body to form an individual spray gun for use in a smaller working area and a high mobility site.
3. For suiting to a large working area and long working period of the working environment, the present invention can be joined into a pipe dual spray gun by securing the pipe on the T-shaped main body.

So the present invention can suit any working environment by changing the combination style, in any of three ways.

I claim:

1. A dual spray gun for painting and cleaning comprising:

a) a three-way T-shaped main body having:
   i) an inlet tap hole for securing to an air blowgun, via a combined bolt and locating nut;
   ii) a front tap hole for securing to a blow head;
   iii) a downward sucking tap hole connecting to said front tap hole; and
   iv) a through-hole connecting said front tap hole and said downward sucking tap hole to said inlet tap hole for locating an atomized nozzle from the inlet tap hole side so as to allow a tip end of said nozzle to stretch inside of said front tap hole and above said downward sucking tap hole;

wherein said downward sucking tap hole is used for securing a pipe connection thereon, at one end of a pipe;

b) a filter connection holding a filter leaf for filtering foreign matter and being on the other end of said pipe; and c) an internal screw on an inside of said filter connection for securing on a bolt with a through-hole on a cap of a tank and sealing with an O-ring;

wherein said bolt with a through-hole on a top side of said cap is secured to said filter connection;

wherein said cap has a sucking tube extending from a bottom side thereof connecting a through-hole of said bolt with a through-hole on the top side of said cap with a top end of said sucking tube for sucking up paint or cleaner in the tank; and wherein said cap has a pair of pivoting holes for a handle for carrying.

2. A dual spray gun for painting and cleaning as claimed in claim 1, wherein said bolt with a through-hole on the cap of the tank is secured to the downward sucking tap hole of said three-way T-shaped main body to construct a tin dual spray gun for painting and cleaning.

3. A dual spray gun for painting and cleaning as claimed in claim 1, wherein said downward sucking tap hole of said three-way T-shaped main body is secured to the pipe connection of said pipe to construct a pipe dual spray gun for painting and cleaning.

* * * * *